United States Patent [19]

Rohrer et al.

[11] Patent Number: 4,721,428

[45] Date of Patent: Jan. 26, 1988

[54] TENNIS BALL RETRIEVER

[75] Inventors: David C. Rohrer, Gaston; Daniel F. Rohrer, Redmond, both of Oreg.

[73] Assignee: Double D Corporation, Forest Grove, Oreg.

[21] Appl. No.: 905,857

[22] Filed: Sep. 10, 1986

[51] Int. Cl.[4] ..... B60P 1/00

[52] U.S. Cl. ..... 414/439; 273/29 R; 56/328.1

[58] Field of Search ..... 414/434, 437; 438, 439, 414/440, 441; 198/512, 518, 624; 294/19.2; 273/29 R, 32 B, 397; 124/78; 193/38, 41; 56/328 R

[56] References Cited

U.S. PATENT DOCUMENTS

| | | | |
|---|---|---|---|
| 1,099,540 | 6/1914 | Douglass | 414/440 X |
| 2,658,637 | 11/1953 | Bailey | 414/440 |
| 4,063,769 | 12/1977 | Zimmer | 294/19.2 |

*Primary Examiner*—Robert J. Spar
*Assistant Examiner*—Stuart J. Millman
*Attorney, Agent, or Firm*—Klarquist, Sparkman, Campbell, Leigh & Whinston

[57] ABSTRACT

A tennis ball retrieving apparatus comprises a wheeled vehicle having a front end and a rear end. The vehicle has a ball storage container disposed at a level enabling ready removal of balls therefrom by a person next to the vehicle while the person is in a standing position. There are a pair of horizontal ball gathering arms at the front of the vehicle arranged in V formation to provide an apex portion to which gathered balls are fed. A pair of the wheels of the wheeled vehicle are in traction contact with the surface on which the vehicle is supported to be driven thereby in rotary fashion as the vehicle is moved over the supporting surface. The wheels are supported with the lower portions of the tires spaced from one another less than the diameter of a tennis ball so as to grip the same when a ball is fed thereto. A chute extends from the area just rearwardly of the lower portions of the tires upwardly to the storage container. The feed wheels are operable by successively feeding balls into the chute to cause previously fed balls by nudging contact to be fed upwardly to deposit the balls into the storage container.

4 Claims, 6 Drawing Figures

FIG. 3
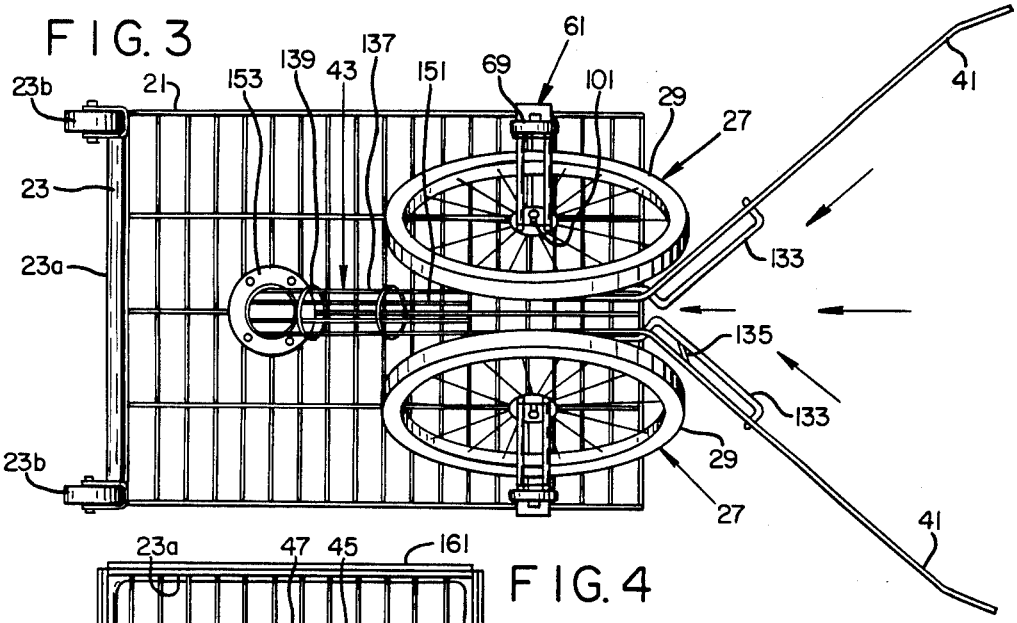
FIG. 4
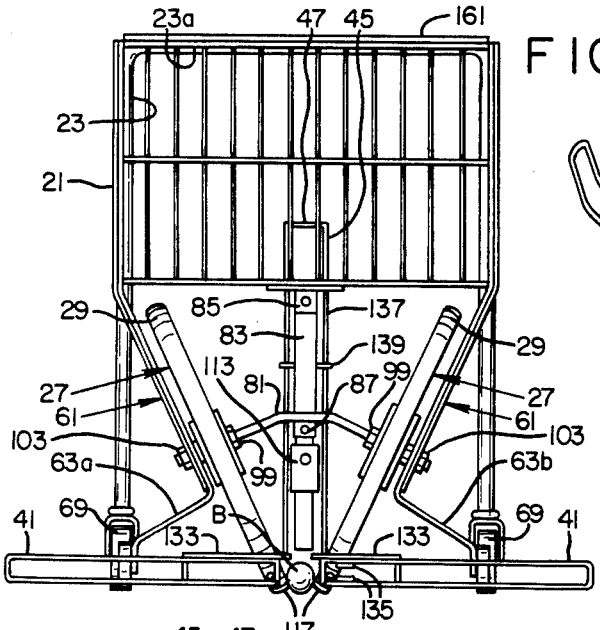
FIG. 6
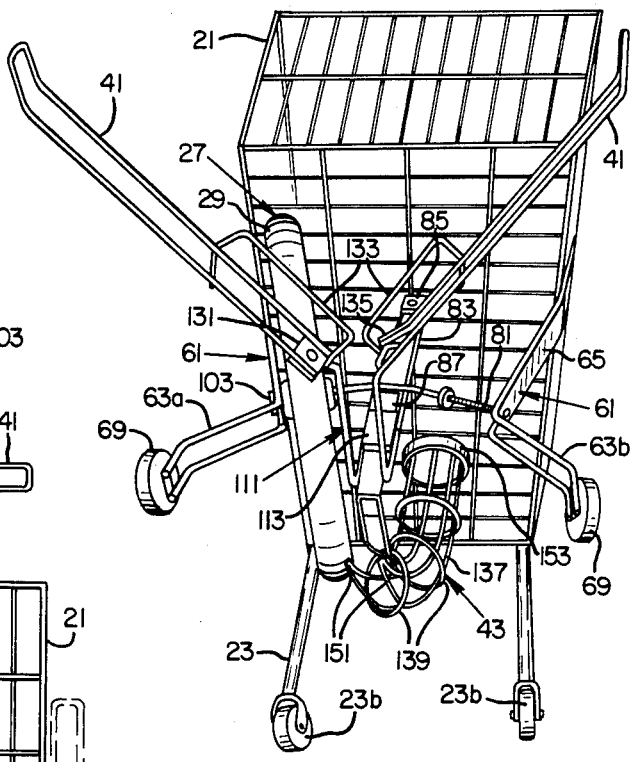
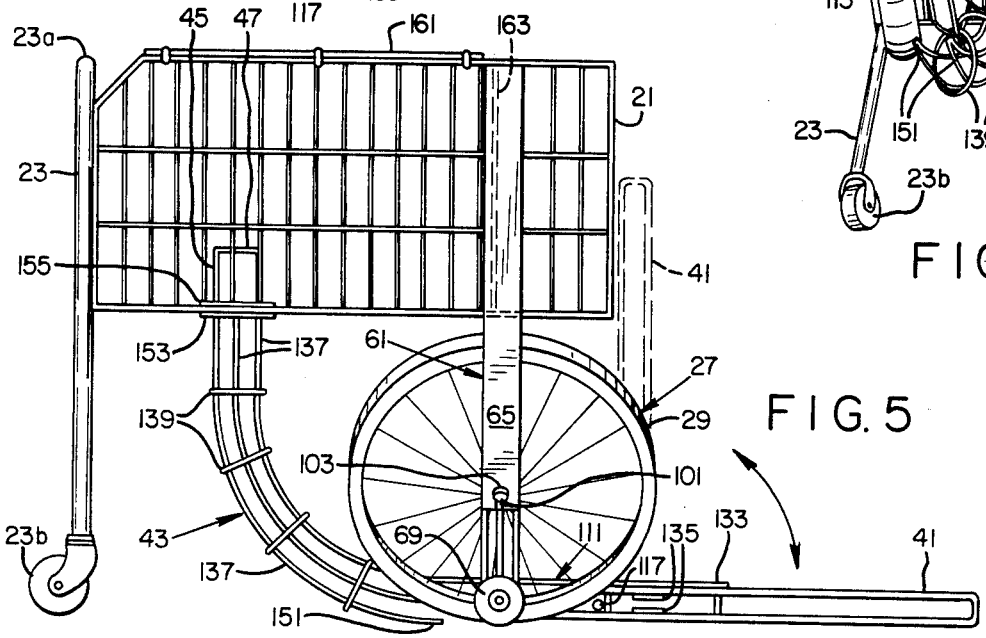
FIG. 5

TENNIS BALL RETRIEVER

Background of the Invention

The present invention relates to tennis ball retrivers. I am aware that the general idea of a tennis ball retriver is not new. There are various types of hand held devices having a trap of some kind or other at the bottom to enable a person walking around a court to pick up tennis balls one by one.

There are otehr devices for gathering tennis balls, but none have been widely adopted. It is believed that the reason for this is that they do not operate efficiently, or are clumsy to operate, or malfunction, or for other reasons.

I am aware of he following U.S. patents relating to ball retrieers, U.S. Pat. Nos. 4,221,524 4,280,697, 4,318,654, 3,485,398, 4,383,695, 4,004,806, 3,819,049, 4,412,697, 4,077,533, 4,116,192, 4,461504, and 3,215,293, but they do not fill the requirements of the trade. I am also aware of the following foreign patents, which appear to be similarly deificient: French Pat. Nos. 2,459,668, 2,555,455, 3,526,667 and 2,511,256; West German Pat. Nos. 3,362,579, 2,262,880, 2,419,712, 3,144,970, 3,103,875, 3,063,188, 2,965,847 and 2,430,916; Austrian Pat Nos. 7,907,515; Russian Pat. No. 795,546; and European Pat. Nos. 16,804, 29,821 and 94,267.

BRIEF DESCRIPTION OF THE DRAWINGS

The subject matter which I regard as my invention is particularly pointed out and distinctly claimed in the concluding portion of this specification. The invention, however, both as to organization and method of operation, together with further advantages and objects thereof, may be best understood by reference to the following description, taken in connection with the following drawings, wherein like reference characters refer to like elements.

FIG. 3 is a bottom view of the vehicle;

FIG. 4 is a front view of the vehicle;

FIG. 5 is a side view of the vehicle; and

FIG. 6 is a perspective view looking at the bottom of the vehicle.

DESCRIPTION OF THE PREFERRED EMBODIMENT

Figure 1:
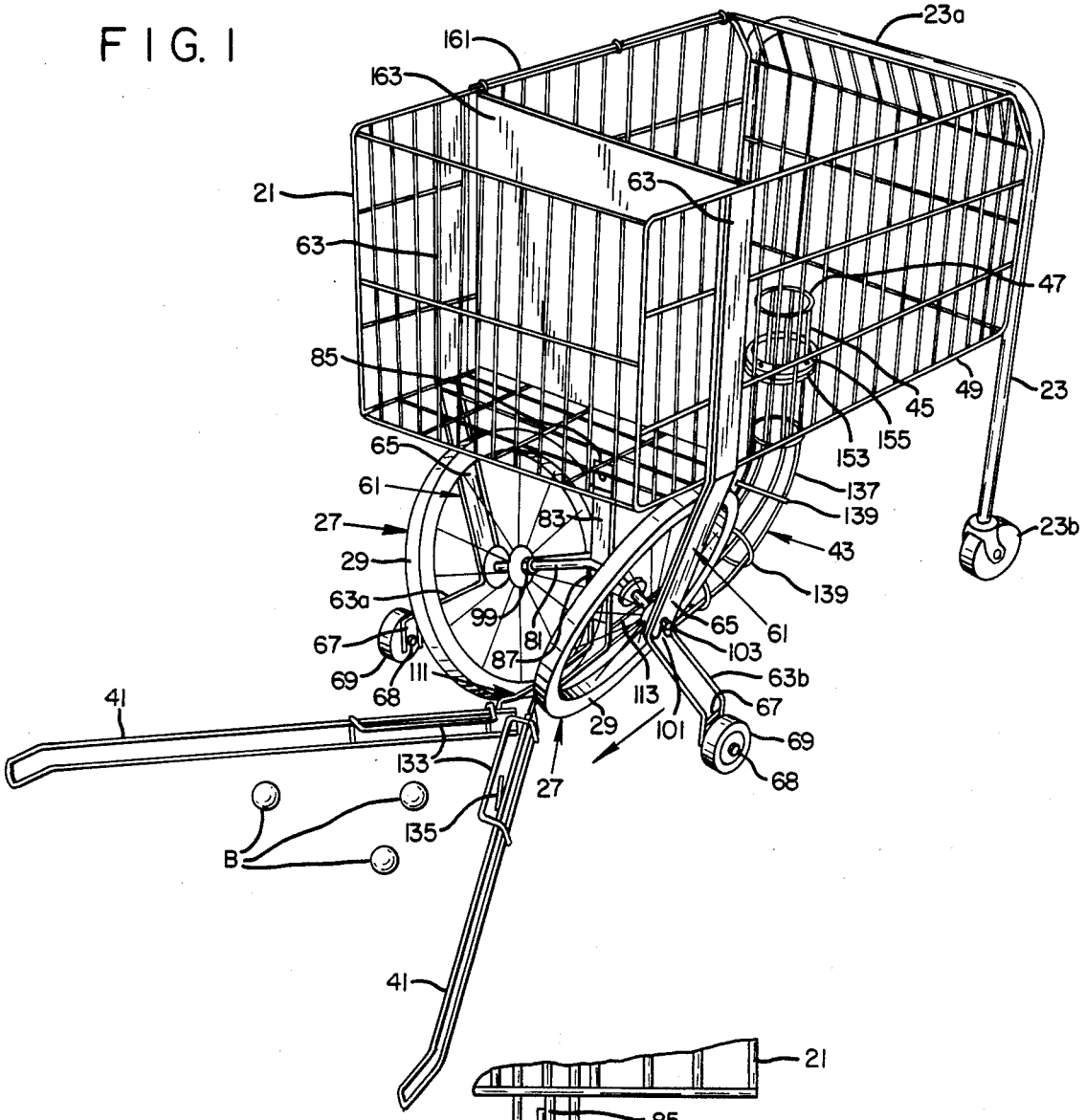
FIG. 1 is a perspective view of a vehicle incorporating the invention, taken generally from the front.

Referring to the drawings, FIG. 1 shows a tennis ball retrieving wheeled vehicle incorporating the concepts of the present invention. The wheeled vehicle is to be pushed or driven around a tennis court area to collect balls B and is particularly useful during practice sessions, where a substantial number of balls is used, to collect such balls and deposit the same in a basket 21. The accumulated balls are then ready for use during succeeding practice sessions.

The vehicle does not have a frame, as such. It includes the rectangular wire basket 21 having a rear end and a front end. To the rear end is secured an inverted U-shaped frame member 23 having caster wheels **23*b* at its lower ends. The upper end 23*a* is used as a handle. At its front end, the basket is supported by a pair of feed wheels 27 having low pressure pneumatic tire 29**. In the particular form of the invention shown the wheels are mounted for rotary movement in dihedrally related planes, and thus rotate about askew axes. The planes are parallel to the longitudinal axis of the vehicle.

The arrangement is such that the lower opposed portions of the tires are spaced apart a distance sufficiently less than the diameter of a tennis ball as to grip a ball when a ball is fed between the lower portions of the tires.

A pair of gathering arms 41 are disposed forwardly of the vehicle, and as the vehicle is moved around, the arms gather tennis balls and feed them in single file fashion between the lower opposed portions of the tires 29. Such portions grip each ball and by virtue of the rotary movement imparted to the wheels, by their traction movement across a tennis court surface, feed the balls rearwardly into the entry mouth of what might be called a chute, duct or passageway 43. The chute leads from a point just rearwardly of the lower portions of the tires upwardly and into the basket, preferably terminating in a riser portion 45 whose discharge mouth 47 is disposed above the floor 49 of the basket 21.

As each ball is fed into the chute, it forces or nudges the previous balls progressively upward in the chute 43, until they percolate out the discharge mouth 47 and into the basket 21, where they accumulate.

Note that the size of the tires is such that they grip a ball at, or slightly above, the center of the ball, and so maintain the ball in contact with the traction surface until the ball enters the chute.

The various parts of hte vehicle are supported and mounted as follows. Secured to the sides of the basket and extending downwardly from the forward portions thereof are a pair of fork arms 61 which are bent inwardly just below the bottom of hte basket at angles to determine the dihedral panes in which the wheels rotate. While the arms can be constructed in many ways, I have found it convenient to form eah of a piece of rod or heavy wire 63 bent to provide a closed upper end and a pair of depending parallel legs **63*a* and 63*b***. These legs are welded or otherwise secured to the sides of the basket.

Secured to each pair of legs is a metal strip 65. Each pair of legs extends below the lower ends of the associated metal strip 65 where each pair is joined by an axle support plate 67 (FIG. 1). Each axle support plate carries an axle 68 rotatably supporting a stabilizing wheel 69. The stabilizing wheels are for balance, and do not actually contact the tennis court surface, because if bot did, that could interfere with the traction required to drive the feed wheels 27. Thus the stabilizing wheels 69 prevent inadvertent sidewise tipping of the tennis ball retrieving vehicle, when in use.

I have chosen to support the feed wheels by a common axle 81 (FIGS. 1 and 4) which is of bent angular form for supporting the bearings (not shown) for the feed wheels 27.

While the feed wheels can be supported in various ways, I have elected to construct the common axle out of a section of threaded bar stock fixed at its central portion to a depending centrally disposed frame member 83. The latter is secured at its upper end to the bottom of the basket.

Figure 2:
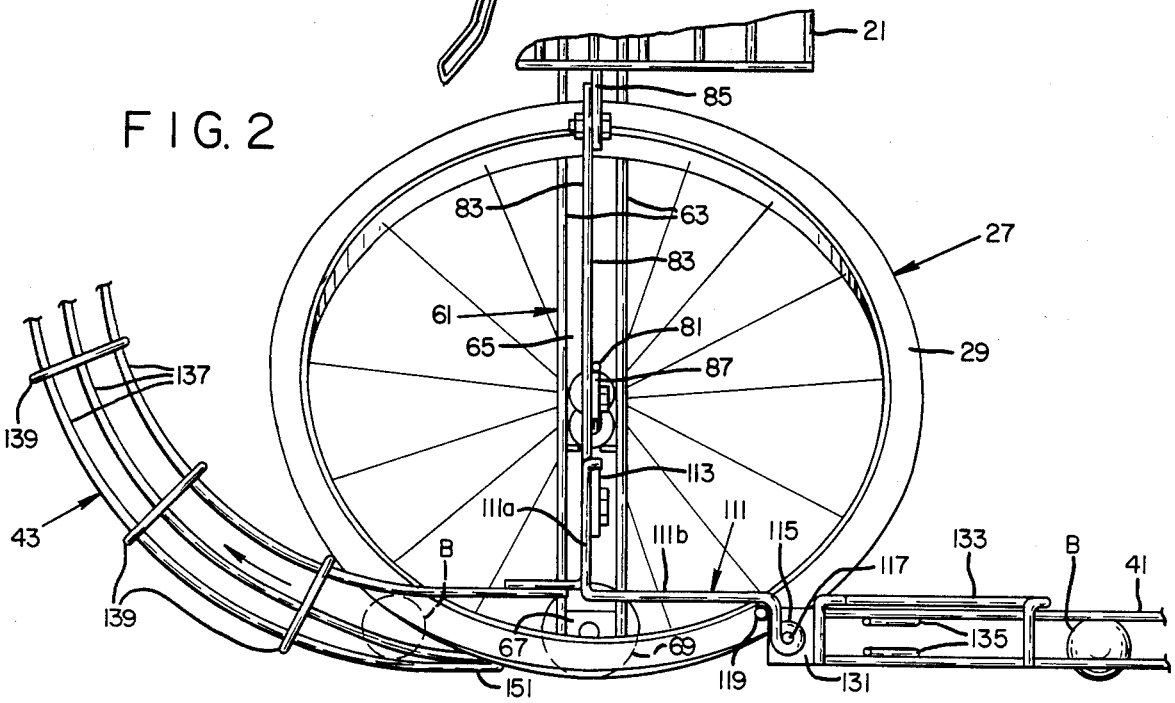
FIG. 2 is a fragmentary section taken just to one side of a vertial midsection.

To enable ready assembly and disassembly, I prefer to weld or otherwise secure to the bottom of the basket a hanger piece 85 (FIG. 2), to which the upper end of the frame member is bolted. Also, the common axle 81, rather than being welded directly to the lower end of the frame member 83, is welded instead to a mounting piece 87 (FIGS. 2 and 4), the mounting piece being bolted to the frame member.

On the common axle 81 I provide a pair of lock nuts 99 (FIG. 4) for each wheel, for determining the lateral inward disposition of the wheels. The ends of the common axle project through end slots 101 (FIG. 3) formed in the lower ends of the metal strips 65. Nuts 103 (FIG. 4) thread on the outer ends of the axles to retain the wheels in place.

By unbolting the common axle 81 from the frame member 83, and by unthreading the nuts 103, the feed wheels can be removed for servicing, maintenance and the like.

A support structure 111 (FIGS. 1, 2 and 6) is provided for supporting the gathering arms 41. The support structure is of angular form having a vertical portion and horizontal portion. The latter is disposed at a level just above the level of the top surfaces of the balls being fed beneath such portion by the feed wheels.

The support struture can be formed in any desired manner but I have shown it formed of a section of rod bent to provide a pair of parallel vertical legs 111*a* (FIG. 2) having an upper closed end. At such place, I fix a mounting plate 113 which is bolted to the lower portion of the frame member 83.

The bent rod provides horizontal legs 111*b* (FIG. 2) which project forwardly beyond the adjacent portions of the pneumatic tires 19 and are then bent downwardly and outwardly (compare FIGS. 2 and 6) so that each supports a journal 115 for a pivot shaft 117. Each gathering arm 41 turns at its inner end on the associated pivot shaft, to thereby enable the gathering arms to be pivoted from their horizontal gathering positions, upwardly and inwardly to essentially parallel vertical out-of-the-way positions (FIG. 5) Thus after a desired number of balls have been collected in the basket, the gathering arms can be moved to their inactive positions. This allows the useer to readily move the wheeled vehicle, with its basket of balls, around for use in practice sessions without interference by the gathering arms.

Each gathering arm is provided with an inner extension forming a stop 119 (FIG. 2) to limit downward movement of the associated arm 41 to an essentially horizontal position.

While the gathering arms can be formed in a number of ways, as shown, each gathering arm comprises a section of rod or heavy wire bent medially to provide a blunt, rounded nose portion, and a pair of parallel legs. Each pair of parallel legs carries a mounting piece 131 (FIGS. 2 and 6) at its inner end through which the associated pivot shaft 117 extends.

The curved blunt noses of the gathering arms prevent their being caught in netting or netting type curtains typically used in tennis practice areas.

At the inner end of each of hte gathering arms, I provide a guard rail or ball deflector 133 which overlies this area near the vertex of the gathering area, when the arms are in their operative positions, to keep the balls from tubling over the arms at the vertex. The deflectors are of slightly different form and positioned and designed so that when the arms are folded from their gathering positions to their vertical parallel inactive positions, the deflectors 133 can bypass one another.

When the gathering arms are disposed in their vertical inactive positions, they, and particularly the deflectors 133, block access to balls disposed within the chute 43 (for a purpose to be presently set forth).

At the inner end protion of one of the gathering arms, I provide a routing element 135 in the form of a pair of bars, which serve to assure that the balls, being crowded toward the vertex by the gathering arms, are fed singly between the tires of the feed wheels.

Note that the gathering arms 41 have their forward or outer ends bent ends bent in a forward direction so that they can better perform their gathering function.

The chute or passageway 43 can be formed in a number of ways. In the drawings it is shown as comprising plural rods or heavy wire 137 (FIGS. 5 and 6) welded to the inner edges of a series of rings 139 so that the rods 137 define a passageway or chute of circular cross section of a diameter slightly larger than that of a tennis ball.

Below the lowest ring, the lower rods are joined so as to provide a pair of forwardly projecting collector elements 151 (FIGS. 2 and 5) which are disposed at a level such that they just clear the tennis court surface.

The proximity of the forward portions of the collector elements alomost but not quite extend to a vertical plane containing the common axle. In any event, their disposition is such that the feed wheels positively feed tennis balls in serial fashion into the chute.

The upper rods of the chute, next to the entry mouth of the chute, are secured such as by welding (FIG. 2) to the lower end of the frame member 83.

The entry mouth of the chute is made of slightly less diameter than that of the balls, so that the balls, once being fed into the chute, will not roll out. This allows the vehicle to be moved in a reverse direction without backfeeding of the balls by the feed wheels.

The manner of fastening the opposite or upper end of the chute or passageway to the basket is as follows: the rods 137 have their upper ends welded or otherwise secured to a circular flange 153 (FIGS. 1 and 5). The latter is secured by nuts to bolts carried by a second circular flange 155 which is welded or otherwise secured to the floor of the basket. The second circular flange carries the riser 45

The wire basket has a hinged lid 161 to cover the top of the basket when desired. FIG. 1 shows the lid open, while FIG. 4 shows it closed. A lock (not shown) may be provided to lock the lid closed. A lock can also be provided for the upper ends of the gathering arms to lock them in their inactive positions. When both locks are used, pilfering of balls is prevented, because access through the lid is closed, and access to the entry mouth of the chute is blocked by the lower ends of the arms 41.

Preferably the forward portion of the basket has an open top compartment provided by a separator 163, in which the miscellaneous items or even racquets, can be placed for the convenience of the user. The separator, if desired, can comprise a wire grid section.

What is claimed is:

1. A tennis ball retrieving apparatus comprising:

a wheeled vehicle to ride upon a tennis court playing surface or like surface, gathering means for gathering balls on said surface as the vehicle travels therealong, and for directing the balls to a loading zone, a pair of feed wheels on said vehicle having opposed portions to grip each ball at the loading zone and feed each ball toward a conveying zone, said feed wheels being driven by traction contact with the playing surface, a storage means providing a storage zone for the balls located at a level above the loading zone, and conveying means at the conveying zone to direct balls upwardly to the storage zone, said conveying means comprising a chute extending from the loading zone to the storage zone and operable to direct balls from the former to the latter, said feed wheels being operable to cause upward movement of the balls in said chute by feeding successive balls into said chute to urge previously fed balls along said chute in successive fashion.

2. An apparatus as described in claim 1, wherein said chute has an entry mouth, means at said mouth to prevent balls, once entering the mouth, from freely rolling therefrom.

3. A tennis ball retrieving apparatus comprising a wheeled vehicle having a front end and a rear end, said vehicle having a ball storage container disposed at a level enabling ready removal of balls therefrom by a person next to the vehicle while the person is in a standing position, a pair of horizontal ball gathering arms at the front of said vehicle arranged in V formation to provide an apex portion to which gathered balls are fed, said arms being disposed at a level just above that of the surface supporting said wheeled vehicle, a pair of the wheels of said wheeled vehicle being in traction cotnact with the surface on which the vehicle is supported to be driven thereby in rotary fashion as the vehicle is moved over the supporting surface, said wheels having pneumatic tires, means supporting said wheels with the lower portions of the tires spaced rom one another less than the diameter of a tennis ball so as to grip the same when a ball is fed thereto, the lower portions of said tires being disposed just rearwardly of the apex formed by said gathering arms so as to receive balls gathered by said gathering arms and feed such balls rearwardly, a chute extending from the area just rearwardly of the lower portions of the tires upwardly to said storage container, said chute having an entry mouth disposed to receive balls from said feed wheels, said feed wheels being operable by successively feeding balls into said chute to cause previously fed balls by nudging contact to be fed upwardly to deposit said balls into said storage container.

4. An apparatus as described in claim 3 in which said wheels are mounted for rotary movement in upwardly diverging dihedral planes, said gathering arms being pivotally mounted for movement from their operative V formation positions upwardly to parallel inactive positions, stop means to hold said arms in substantially horizontal positions when said arms are moved from their inactive to their operative positions, said arms in their inactive positions blocking access to the entry mouth of said chute from a direction at the front of said vehicle, means locally of the mouth of said chute to prevent reverse movmenet of balls fed into said chute.

* * * * *

UNITED STATES PATENT AND TRADEMARK OFFICE

CERTIFICATE OF CORRECTION

PATENT NO. : 4,721,428

DATED : January 26, 1988

INVENTOR(S) : David C. Rohrer and Daniel F. Rohrer

It is certified that error appears in the above-identified patent and that said Letters Patent is hereby corrected as shown below:

In the Abstract:

Line 8, after "fed." insert:

--The arms are disposed at a level just above that of the surface supporting the wheeled vehicle.--;

Line 12, before "The" (second occurrence) insert:

--The wheels have pneumatic tires.--;

Line 16, after "thereto." insert:

--The lower portions of the tires are disposed just rearwardly of the apex formed by said gathering arms so as to receive balls gathered by said gathering arms and feed the balls rearwardly.--; and Line 18, after "container." insert:

--The chute has an entry mouth disposed to receive balls from the feed wheels.--

Column 1, line 11, "otehr" should be --other--;

Column 1, line 16, "he" should be --the--;

Column 1, line 17, "retrieers" should be --retrievers--; after "4,221,524" insert --,-- (a comma);

UNITED STATES PATENT AND TRADEMARK OFFICE

CERTIFICATE OF CORRECTION

PATENT NO. : 4,721,428

DATED : January 26, 1988

INVENTOR(S) : David C. Rohrer and Daniel F. Rohrer

It is certified that error appears in the above-identified patent and that said Letters Patent is hereby corrected as shown below:

Column 1, line 19, "4,461504" should be --4,461,504--;

Column 1, line 22, "deificient" should be --deficient--;

Column 1, line 23, "3,526,667" should be --2,526,667--;

Column 1, line 26, after "Pat" insert --.-- (a period); "Nos." should be --No.--;

Column 1, line 42, "vertial" should be --vertical--;

Column 1, line 66, "tire" should be --tires--;

Column 2, line 29, "hte" should be --the--;

Column 2, line 33, "hte" should be --the--;

Column 2, line 34, "panes" should be --planes--;

Column 2, line 36, "eah" should be --each--;

Column 2, line 48, "bot" should be --both--;

Column 3, line 17, after "and" insert --a--;

Column 3, line 20, "struture" should be --structure--;

Column 3, line 35, after "(FIG. 5)" insert --.-- (a period);

UNITED STATES PATENT AND TRADEMARK OFFICE

CERTIFICATE OF CORRECTION

PATENT NO. : 4,721,428

DATED : January 26, 1988

INVENTOR(S) : David C. Rohrer and Daniel F. Rohrer

It is certified that error appears in the above-identified patent and that said Letters Patent is hereby corrected as shown below:

Column 3, line 38, "useer" should be --user--;

Column 3, line 56, "hte" should be --the--;

Column 3, line 58, "this" should be --the--;

Column 3, line 60, "tubling" should be --tumbling--;

Column 4, line 1, "protion" should be --portion--;

Column 4, line 7, delete "ends bent" (second occurrence);

Column 4, line 21, "alomost" should be --almost--; and

Column 4, line 40, after "45" insert --.-- (a period).

Column 5, line 27, claim 3, "cotnact" should be --contact--;

Column 6, line 2, claim 3, "rom" should be --from--; and

UNITED STATES PATENT AND TRADEMARK OFFICE

CERTIFICATE OF CORRECTION

PATENT NO. : 4,721,428

DATED : January 26, 1988

INVENTOR(S) : David C. Rohrer and Daniel F. Rohrer

It is certified that error appears in the above-identified patent and that said Letters Patent is hereby corrected as shown below:

Column 6, line 31, claim 4, "movmenet" should read -- movement --.

Signed and Sealed this

Thirtieth Day of August, 1988

*Attest:*

*Attesting Officer*

DONALD J. QUIGG

*Commissioner of Patents and Trademarks*